US005742302A

United States Patent [19]

Kohri et al.

[11] Patent Number: 5,742,302

[45] Date of Patent: Apr. 21, 1998

[54] LIQUID JETTING APPARATUS AND METHOD OF CONTROLLING RECOVERY BASED ON DETECTION OF MOUNTED HEAD

[75] Inventors: Shinichiro Kohri, Kawasaki; Shunichi Tachibana, Urayasu, both of Japan

[73] Assignee: Canon Kabushiki Kaisha, Tokyo, Japan

[21] Appl. No.: 597,384

[22] Filed: Feb. 8, 1996

Related U.S. Application Data

[63] Continuation of Ser. No. 92,781, Jul. 19, 1993, abandoned.

[30] Foreign Application Priority Data

Jul. 24, 1992 [JP] Japan ..... 4-198657

[51] Int. Cl.[6] ..... B41J 2/165

[52] U.S. Cl. ..... 347/23; 347/30; 347/49

[58] Field of Search ..... 347/2, 3, 5, 14, 347/22, 23, 30, 33, 19, 49, 86, 87

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,436,439 | 3/1984 | Koto | 347/87 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,740,796 | 4/1988 | Endo et al. | 347/56 |
| 4,893,138 | 1/1990 | Terasawa et al. | 347/30 |
| 4,970,533 | 11/1990 | Saito et al. | 347/86 |
| 5,121,131 | 6/1992 | Bouldin et al. | 347/2 |
| 5,132,710 | 7/1992 | Ejiri et al. | 347/3 |
| 5,168,291 | 12/1992 | Hiramatsu et al. | 347/29 |
| 5,177,505 | 1/1993 | Sugiura et al. | 347/33 |
| 5,289,207 | 2/1994 | Ebisawa | 347/23 |

FOREIGN PATENT DOCUMENTS

| | | | |
|---|---|---|---|
| 0430077 | 6/1991 | European Pat. Off. . | |
| 0443832 | 8/1991 | European Pat. Off. . | |
| 0446885 | 9/1991 | European Pat. Off. . | |
| 05 35 686 | 4/1993 | European Pat. Off. | 347/23 |
| 0551752 | 7/1993 | European Pat. Off. . | |
| 05 56 011 | 8/1993 | European Pat. Off. | 347/23 |
| 54-056847 | 5/1979 | Japan . | |
| 59-123670 | 7/1984 | Japan . | |
| 59-138461 | 8/1984 | Japan . | |
| 60-071260 | 4/1985 | Japan . | |
| 64-071781 | 3/1989 | Japan . | |
| 4-347654 | 12/1992 | Japan | 347/5 |
| 4-347655 | 12/1992 | Japan | 347/30 |

*Primary Examiner*—John E. Barlow, Jr.

*Attorney, Agent, or Firm*—Fitzpatrick, Cella, Harper & Scinto

[57] ABSTRACT

A liquid jetting apparatus for jetting a liquid employing a liquid jetting head includes a capping member for covering a liquid jetting region of the liquid jetting head when the liquid jetting head is mounted, a driver for driving the capping member, a detector for detecting that the liquid jetting head is mounted, and a controller for controlling the driving of the capping member by the driver when the dectector detects that the liquid jetting head is mounted, so as to first seperate the capping member from the liquid jetting region of the liquid jetting head and then cause to cover again the liquid jetting region of the liquid jetting head.

13 Claims, 10 Drawing Sheets

19A
17
24
18
16
21
19B
20
40
31A
31
26A
26
22
23
1URA

LIQUID JETTING APPARATUS AND METHOD OF CONTROLLING RECOVERY BASED ON DETECTION OF MOUNTED HEAD

This application is a continuation of application Ser. No. 08/092,781 filed Jul. 19, 1993, now abandoned.

BACKGROUND OF THE INVENTION

1. Field of the Invention

The present invention relates to a liquid jetting apparatus and a liquid jetting method.

2. Related Background Art

Conventionally, recording apparatuses employing a variety of image forming means have been practically used, and particularly, an ink jet recording apparatus has been widely accepted which performs the recording by discharging the ink through ink discharge orifices of recording head onto recording medium by the use of heat energy.

The present inventors have devised to construct a facsimile apparatus by employing such an ink jet recording apparatus as a printer unit.

However, none have been conventionally known which comprise a recovery mechanism for effecting ink discharge recovery by sucking the ink through nozzles of recording head.

Also, in a recording method of the ink jet system, where the recording head is exposed to the atmosphere without being capped by capping means when the recording is stopped halfway during the recording, or the recording head is left unused for a long time, the ink remaining in nozzles of recording head may be dried so that the nozzles are susceptible to clogging. Nozzle clogging will give rise to fatal error on the recording operation, and must be prevented to the utmost.

Also, where an ink cartridge of head integral type is used, if a newly used cartridge has nozzles containing the air, or air bubbles arise therein due to the printing operation for a long time, it is necessary to conduct a suction recovery operation for further printing in which the ink is sucked through nozzles, together with air bubbles, using a pump. However, when the recording head is exchanged as above described, no capping operation has been conventionally performed, and the present inventors have found a problem that if the recording head is left away without capping, or the discharge orifice face of recording head is in contact with the external air with insufficient capping, not only the nozzles may be clogged, but also the suction recovery operation may not be reliably conducted.

Also, there was the problem that the operator could not readily confirm whether or not ink undischarge was resolved after the discharge recovery operation of recording head was ended, even though the operator wanted to make a confirmation.

SUMMARY OF THE INVENTION

An object of the present invention is to provide a liquid jetting apparatus which makes it possible to prevent the clogging of nozzles reliably by firmly capping a liquid jetting region of a liquid jetting head when the liquid jetting head is exchanged.

Also, it is another object of the present invention to provide a liquid jetting apparatus in which the operator can readily confirm whether or not ink undischarge is resolved after discharge recovery operation is ended.

Also, it is a further object of the present invention to provide a liquid jetting apparatus for jetting the liquid employing a liquid jetting head, comprising:

capping means openable or closable from or over a liquid jetting region of said liquid jetting head, driving means for driving said capping means, detecting means for detecting that said liquid jetting head is exchanged, and control means for controlling the driving of said driving means so that the liquid jetting region of said liquid jetting head may be covered with said capping means, when said detecting means detects that said liquid jetting head is exchanged.

Also, it is a still further object of the present invention to provide a liquid jetting method for jetting the liquid employing a liquid jetting head, characterized by including, providing capping means openable or closable from or over a liquid jetting region of said liquid jetting head, detecting that said liquid jetting head is exchanged, and covering the liquid jetting region of said liquid jetting head with said capping means, when it is detected that said liquid jetting head is exchanged.

It is another object of the invention to provide a recording apparatus which conducts the recording by employing a recording head for discharging the ink onto a recording medium, comprising:

discharge recovery means for recovering ink discharge through discharge orifices by performing a discharge recovery operation for said recording head, instructing means with which the operator instructs said discharge recovery means to perform the discharge recovery operation, and recording head driving means for driving said recording head to record a checking image onto said recording medium, after said discharge recovery means has performed the discharge recovery operation based on an instruction from said instructing means.

Since, according to the present invention with the above constitution, a driver for capping means is controlled so that the liquid jetting region of liquid jetting head is covered with capping means upon the detection that the liquid jetting head is exchanged, the capping can be firmly made, and owing to a cap placed in close contact with the discharge orifice face, it is possible to prevent the clogging of nozzles, and to provide a reliable suction recovery operation.

Also, since, according to the present invention, a checking image is recorded on the recording medium by automatically driving the recording head after discharge recovery means has performed a discharge recovery operation based on an instruction from instructing means for instructing discharge recovery operation, the operator can readily confirm whether or not ink undischarge is resolved.

DETAILED DESCRIPTION OF THE PREFERRED EMBODIMENTS

Figure 1:
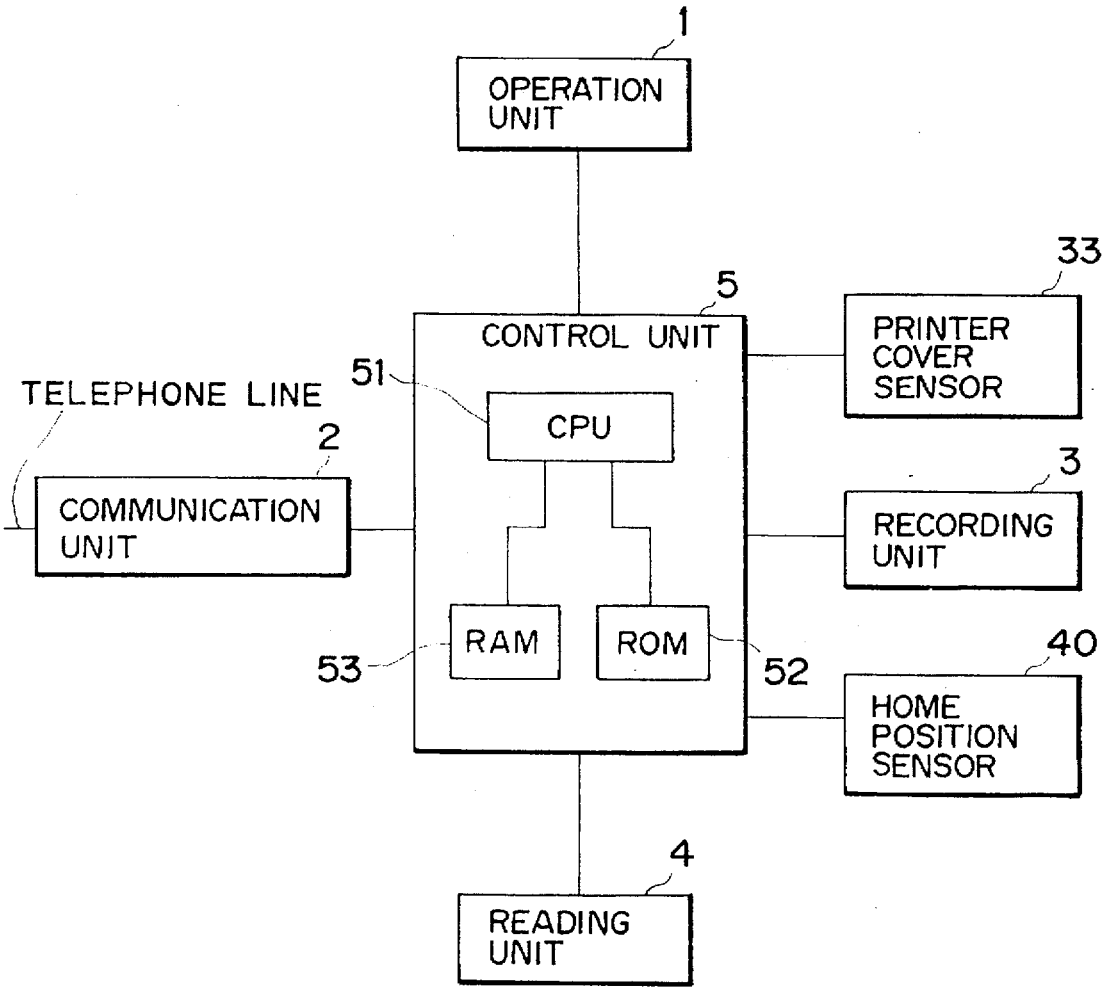
FIG. 1 is a block diagram of a liquid jetting apparatus according to the present invention as applied to a facsimile apparatus.

FIG. 1 is a block diagram of a liquid jetting apparatus according to the present invention as applied to a facsimile apparatus. In FIG. 1, 1 is an operation unit having a button for activating the head cleaning, 2 is a communication unit for performing facsimile transmission and reception to and from the external, 3 is a recording unit for performing the printing, 4 is a reading unit for reading the original, 5 is a control unit as control means for controlling each of the above units 1 to 5, having a CPU 51 for executing processing procedures as will be described later, a ROM 52 for storing fixed data such as programs corresponding to processing procedures, and a RAM 53 for working area. Also, the control unit 5 is connected to a printer cover sensor 33 for detecting the opening and closing of a printer cover, and a home position sensor 40 for detecting whether or not a carriage is located at the home position.

Figure 2:
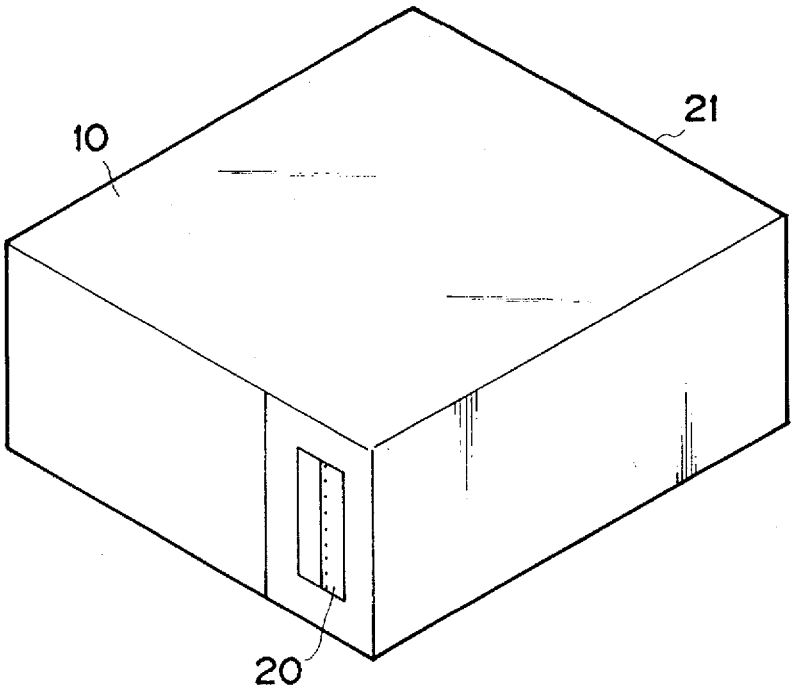
FIG. 2 is a perspective view of an ink cartridge.
Figure 3:
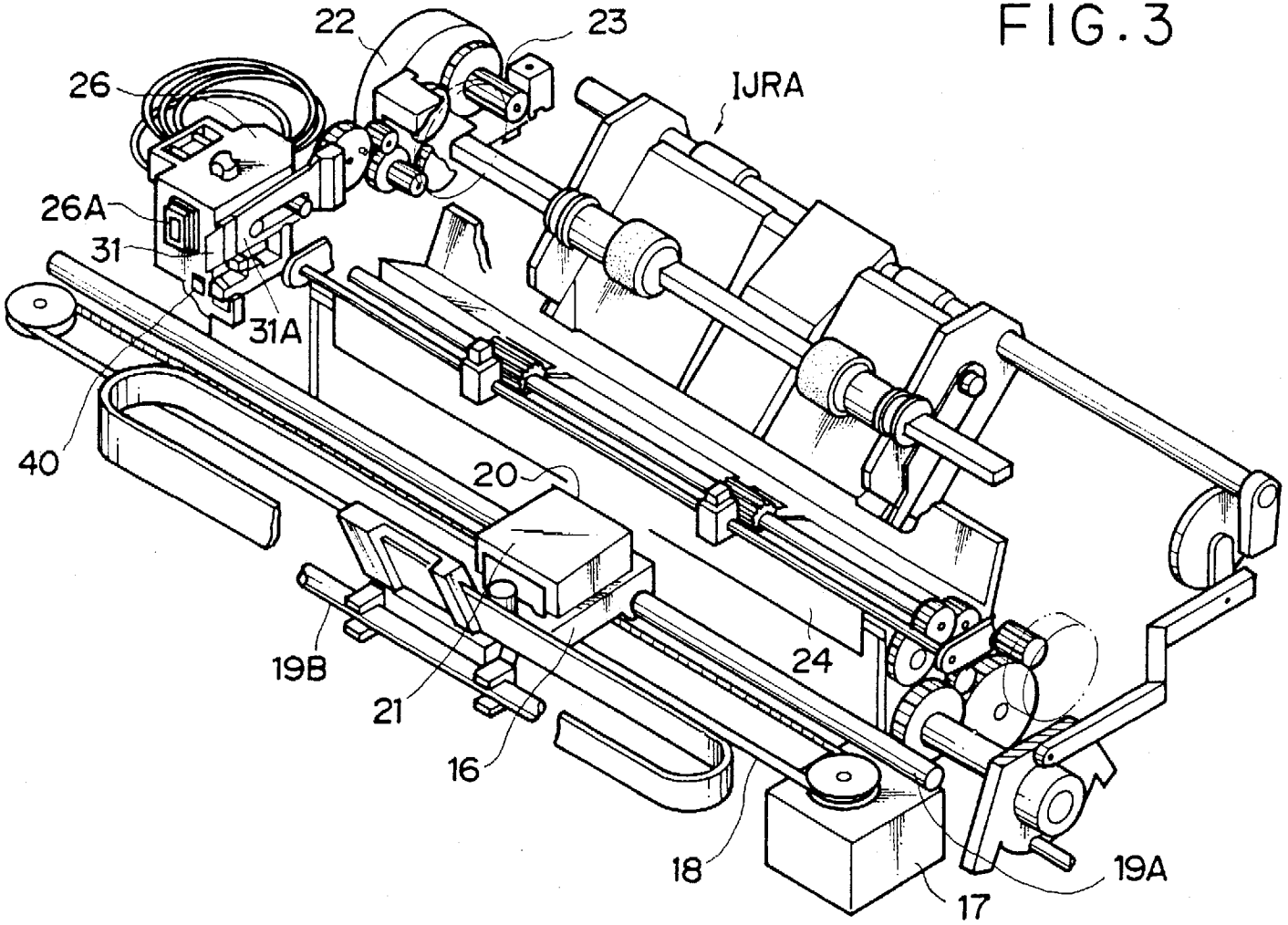
FIG. 3 is an external perspective view illustrating an example of an ink jet recording apparatus.

FIG. 2 is a perspective view illustrating an ink cartridge 21 in which a recording head and an ink tank containing the ink are integrated. Also, FIG. 3 is an external perspective view illustrating an example of an ink jet recording apparatus suitable as a recording system for the facsimile apparatus to which the present invention is applied. In these FIGS. 20 is a recording head of the type in which the ink is discharged onto the recording medium by the use of heat energy, and 10 is an ink tank integrated with the recording head 20 for supplying ink to the recording head 20.

IJRA is an ink jet recording apparatus main body. An ink cartridge 21 in this embodiment has a shape in which a top portion of the recording head 20 is slightly projected from the front face of the ink tank 10. The ink cartridge 21 is supported securely in the carriage 16 provided on the ink jet recording apparatus main body so as to be detachable from the carriage 16.

The ink tank 10 reserving the ink for the supply to the recording head 20 is comprised of an ink absorbing body, a vessel for accommodating the ink absorbing member, and a sealing member for sealing it (neither shown). The ink tank 10 is filled with the ink which is then supplied to the recording head 20 in accordance with the discharge of the ink from the recording head 20.

The ink cartridge 21 as constituted above is detachably mounted on the carriage 16 of ink et recording apparatus IJRA as described below in a predetermined manner, wherein the ink is discharged from the recording head 20 onto the recording medium in accordance with a predetermined recording signal as input thereto, so that a desired recording image is formed by repetitively performing the relative movement between the carriage 16 and the recording medium.

In FIG. 3, 20 is a recording head of the ink cartridge 21 placed opposed to the record face of a recording sheet fed on to a platen 24 and comprising a group of nozzles for ink discharge. 16 is a carriage for carrying the recording head 20 connecting to a part of a driving belt 18 for transmitting the driving force of a driving motor 17 to be slidable on two parallel guide shafts 19A and 19B disposed in parallel to each other so that the recording head 20 is enabled to make reciprocal movement (main scan) over an entire width of the recording sheet. During this reciprocal movement, the recording head 20 records an image corresponding to received data onto the recording sheet. The recording sheet is conveyed (sub-scanned) by a predetermined amount in a direction perpendicular to the main scan direction every time this one main scan is ended. 26 is a head recovery device disposed at one end of the movement path for the recording head, e.g., a position facing the recording head 20 as placed at the home position.

The head recovery device 26 is driven by a driving force of a motor 22 via a transmission mechanism 23 for capping the recording head 20 with a cap portion 26A. That is, the cap portion 26A is placed into close contact with the discharge orifice formation portion of the recording head 20 around the entire periphery thereof. With the recording head 20 capped by the cap portion 26A of this head recovery device 26, the ink suction (suction recovery) is made by appropriate suction means (e.g., suction pump) provided within the head recovery device 26, thereby compulsorily discharging the ink through discharge orifices to effect a discharge recovery operation of removing thickened ink or bubbles within the discharge orifices.

The capping is also made at the end of recording, so that the recording head is protected. The discharge recovery operation is performed at the times when the power is turned on, when the recording head is exchanged, and when no recording operation is not made beyond a fixed time period. 31 is a blade as a wiping member disposed on a side face of the head recovery device 26 and formed of silicone rubber. The blade 31 is held in the cantilevered form by a blade protecting member 31A, and operated by the motor 22 via the transmission mechanism 23, like the head recovery device 26, to be engageable with a discharge face of the recording head 20. Thereby, the blade 31 is activated at an appropriate timing in the recording operation with the recording head 20, or after the discharge recovery operation employing the head recovery device 26, to thereby wipe off dewing, ink wetting or dusts adhering to the discharge face of the recording head 20.

40 is a home position sensor for detecting that the carriage is located at the home position, constituted of a microswitch or a photo-interrupter.

Figure 4:
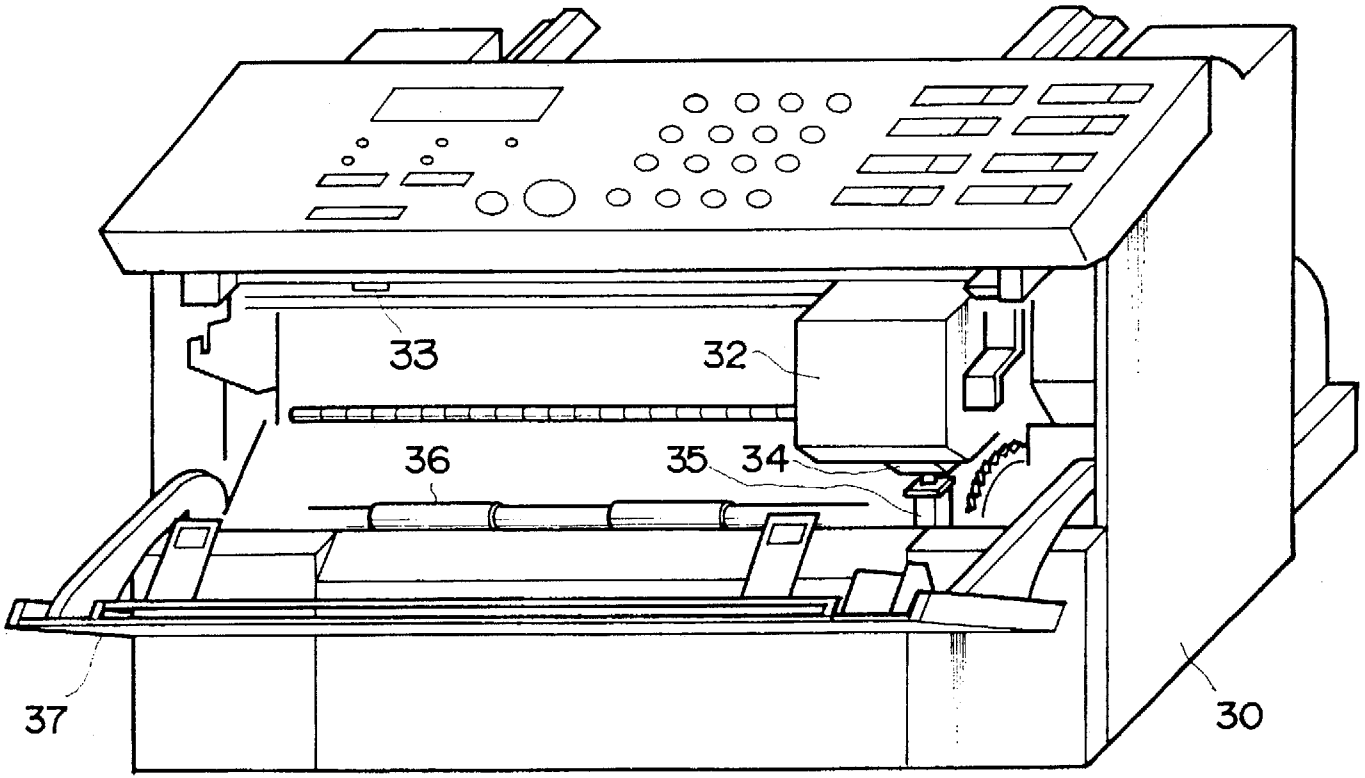
FIG. 4 is a perspective view of a facsimile apparatus main body.

FIG. 4 is a perspective view of a facsimile apparatus main body. By opening or closing a printer cover 37 disposed on the front face of the facsimile apparatus main body, a cover sensor 33 is turned on or off. The cover sensor used may be a microswitch or a photo-interrupter. If the printer cover 37 is opened, the recording is stopped even while the recording operation is being performed, upon which the ink cartridge 32 returns to the home position which is a predefined position for the capping.

If the printer cover 37 is closed, the capping portion of the recovery device 35 is pressed against the recording head 34, whereby the ink suction is effected. The recording sheet is exhausted therefrom by a recording sheet conveying roller 36.

Figure 5:
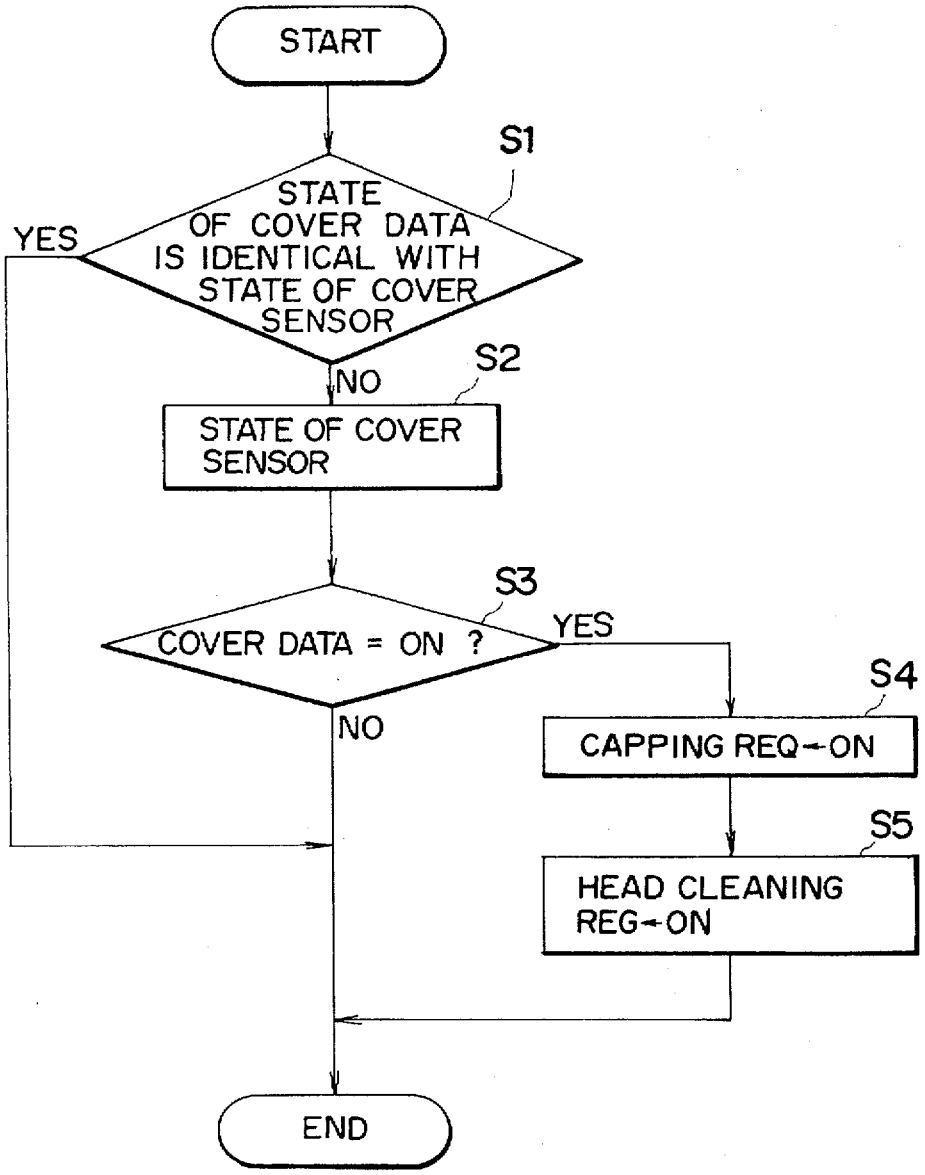
FIG. 5 is a flowchart of a task for monitoring a printer cover.

FIG. 5 is a flowchart of a task for monitoring the printer cover 37, this task being activated simultaneously with the power on, and at every 100 msec. If this task is activated, a check is made to see whether the state of cover sensor 33 is identical with the state of a flag COVER DATA stored (step S1). Cover is open when the cover sensor 33 is on, or closed when it is off. When the state of the cover sensor changes, or is different from the state of the flag COVER DATA, the state of the cover sensor 33 is stored in the flag COVER DATA, which is turned from on to off, or from Off to on (step S2). If the state of the cover sensor 33 does not change at step S1, this task is ended.

Following step S2, the flag COVER DATA is checked (step S3), wherein if it is on, the operation proceeds to step S4, or if it is off, this task is ended. At step S4, a flag CAPPING REQ requesting the capping of recording head is turned on, and at step S5, a flag HEAD CLEANING REQ requesting the head cleaning is turned on, and the task is ended.

Figure 6:
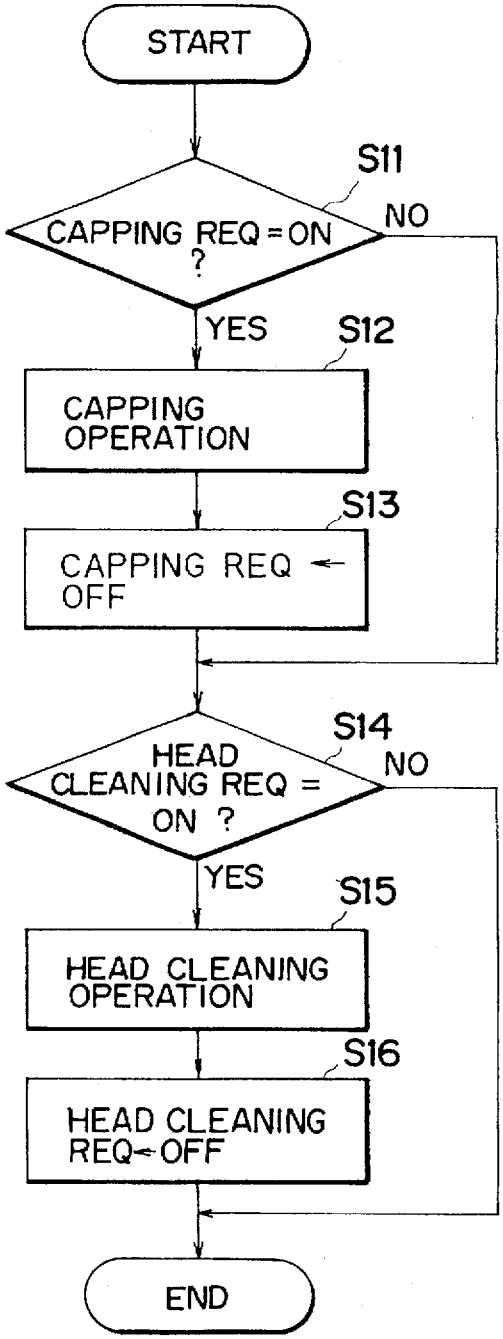
FIG. 6 is a flowchart of an automatic head cleaning task.

While the sensor was attached to the printer cover 37 in this embodiment, it will be appreciated that the sensor may be attached on a portion permitting the confirmation as to whether or not a release lever for the ink cartridge of the recording head integral type is released, or on a cartridge board to allow the sensor to sense that the cartridge is exchanged to perform the same head cleaning operation FIG. 6 is a flowchart of an automatic head cleaning task, this task being activated at every 100 msec.

If this task is activated, a check is made to see whether or not a flag CAPPING REQ is on (step S11). If the flag CAPPING REQ is on, the operation proceeds to step S12, 6r otherwise to step At step S12, a capping start signal for the S14. recording head is sent to the recovery unit of the recording system for the capping operation. Specifically, first, the cap is once separated away from the recording head, and then moved in a main scan direction leaving away from the home position by a predetermined length by driving the carriage. Next, it is moved back to the home position by driving the carriage again, and after the home position sensor detects that the carriage is returned to the home position, the capping is made. After the capping is made in the above way, a capping request flag CAPPING REQ is turned off (step S13), and the operation proceeds to step S14.

The above operation is performed due to the following reason. That is, if the recording head is placed into close contact with the cap within the recovery operation unit, the suction pump becomes more reliable. That is, after the ink cartridge is mounted or dismounted manually, a slight gap is produced between the discharge orifice portion of recording head and the cap, so that the external air may enter through the gap when a suction force is exerted by the suction pump, preventing sufficient suction operation. However, according to the present invention, as above described, after the ink cartridge is mounted or dismounted manually, the capping is automatically made on the device side, so that the suction recovery can be assured At step S14, if the head cleaning request flag HEAD CLEANING REQ is on, the operation proceeds to step S15, or otherwise the task is ended. At step S15, a cleaning start signal of the recording head 20 is sent to the recovery unit of the recording system, which then causes the ink to be sucked through nozzles by driving the suction pump via a suction tube (not shown) in communication with the capping portion 26A in the state of capping the discharge orifice portion of the recording head 20, so that the discharge is recovered to the normal state. After the end of cleaning, the HEAD CLEANING REQ is turned off (step S16), and the task is ended.

It will be understood that this task may be activated immediately before the recording, when the recording such as for copy or report is performed, rather than at every 100 msec. In this way, wasteful suction operation can be reduced. It will be also understood that if a temperature sensor or a humidity sensor attached on the main body or printer head portion may be monitored periodically, and upon sensing the high temperature or low humidity condition at which the ink within the nozzles may dry, this task may be activated.

Figure 7:
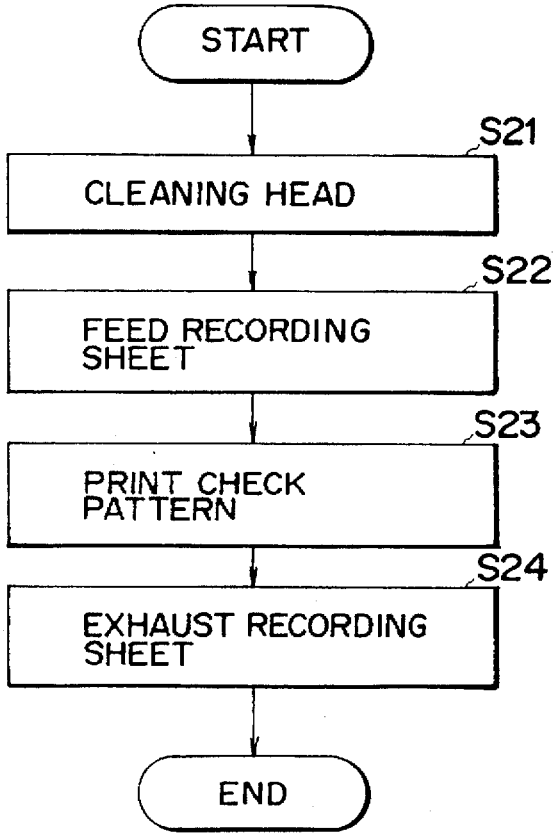
FIG. 7 is a flowchart of a task to be activated upon the depression of a cleaning key.

FIG. 7 is a flowchart of a task to be activated when a cleaning key is depressed. If the cleaning key is depressed, a cleaning start signal of the recording head is sent to the recovery unit of the recording system for performing the head cleaning (step S21). Next, a command for feeding the recording sheet to a recordable position is sent to the recording unit for feeding the recording sheet (step S22). If the feeding is ended, a command for printing check, pattern is sent to the recording unit for printing the check pattern (step S23).

Figure 8:
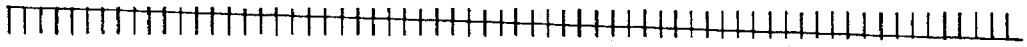
FIG. 8 is a view illustrating a check pattern.

This check pattern allows the confirmation that the ink undischarge is resolved for the recording head having a resolution of 360 dpi with the nozzles arranged in 64 columns and one row, as shown in FIG. 8. That is, since the nozzles for which ink undischarge is not resolved fail to discharge for transverse recording, it is possible to know the nozzle numbers counted from the uppermost position, for which ink undischarge is not resolved, by knowing at what position the transverse recording is lacked. If the printing is ended, a command for exhausting recording sheet is sent to the recording unit to exhaust the recording sheet (step S24), and the task is ended.

The present invention brings about excellent effects particularly in a recording head or a recording device of the ink jet system for recording by forming fine ink droplets by the use of heat energy among the various ink jet recording systems.

As to its representative constitution and principle, for example one practiced by use of the basic principle disclosed in, for example, U.S. Pat. Nos. 4,723,129 and 4,740,796 is preferred. This system is applicable to either of the so-called on-demand type and the continuous type. Particularly, the case of the on-demand type is effective because, by applying at least one driving signal which gives rapid temperature elevation exceeding nucleus boiling corresponding to the recording information on electricity-heat converters arranged corresponding to the sheets or liquid channels holding a liquid (ink), heat energy is generated at the electricity-heat converters to effect film boiling at the heat acting surface of the recording head, and consequently the bubbles within the liquid (ink) can be formed corresponding one by one to the driving signals. By discharging the liquid (ink) through an opening for discharging by growth and shrinkage of the bubble, at least one droplet is formed. By making the driving signals into the pulse shapes, growth and shrinkage of the bubbles can be effected instantly and adequately to accomplish more preferably discharging of the liquid (ink) particularly excellent in response characteristic.

As the driving signals of such pulse shape, those as disclosed in U.S. Pat. Nos. 4,463,359 and 4,345,262 are suitable. Further excellent recording can be performed by employment of the conditions described in U.S. Pat. 4,313,124 of the invention concerning the temperature elevation rate of the above-mentioned heat acting surface.

As the constitution of the recording head, in addition to the combination of the discharging orifice, liquid channel, and electricity-heat converter (linear liquid channel or right-angled liquid channel) as disclosed in the above-mentioned respective specifications, the constitution by use of U.S. Pat. Nos. 4,558,333 or 4,459,600 disclosing the constitution having the heat acting portion arranged in the flexed region is also included in the present invention.

In addition, the present invention can be also effectively made the constitution as disclosed in Japanese Laid-Open Patent Application No. 59-123670 which discloses the constitution using a slit common to a plurality of electricity-heat converters as the discharging portion of the electricity-heat converter or Japanese Laid-Open Patent Application NO. 59-138461 which discloses the constitution having the opening for absorbing pressure wave of heat energy correspondent to the discharging portion.

Further, the recording head of the full line type having a length corresponding to the maximum width of a recording medium which can be recorded by the recording device may be either the constitution which satisfies its length by a combination of a plurality of recording heads as disclosed in the above-cited specifications or the constitution as one recording head integrally formed.

In addition, the present invention is effective for a recording head of the freely exchangeable chip type which enables electrical connection to the main device or supply of ink from the main device by being mounted on the main device, or a recording head of the cartridge type having an ink tank integrally provided on the recording head itself.

Also, addition of a restoration means for the recording head, a preliminary auxiliary means, etc., provided as the constitution of the recording device of the present invention is preferable, because the effect of the present invention can be further stabilized. Specific examples of these may include, for the recording head, capping means, cleaning means, pressurization or suction means, electricity-heat converters or another type of heating elements, or preliminary heating means according to a combination of these, and it is also effective for performing stable recording to perform preliminary mode which performs discharging separate from recording.

Further, as the recording mode of the recording device, the present invention is extremely effective for not only the recording mode only of a primary color such as black, etc., but also a device equipped with at least one of plural different colors or full color by color mixing, whether the recording head may be either integrally constituted or combined in plural number.

In addition, though the ink is considered as the liquid in the embodiments as above described, another ink may be also usable which is solid below room temperature and will soften or liquefy at or above room temperature, or liquefy when a recording signal is issued as it is common with the ink jet device to control the viscosity of ink to be maintained within a certain range of the stable discharge by adjusting the temperature of ink in a range from 30° C. to 70° C.

In addition, in order to avoid the temperature elevation due to heat energy by positively utilizing the heat energy as the energy for the change of state from solid to liquid, or to prevent the evaporation of ink by using the ink which will stiffen in the shelf state, the use of the ink having a property of liquefying only with the application of heat energy, such as liquefying with the application of heat energy in accordance with a recording signal so that liquid ink is discharged, or may solidify prior to reaching a recording medium, is also applicable in the present invention. In such a case, the ink may be held as liquid or solid in recesses or through holes of a porous sheet, which is placed opposed to electricity-heat converters, as described in Japanese Laid-Open Patent Application No. 54-56847 or No. 60-71260. The most effective method for the ink as above described in the present invention is based on the film boiling.

Further, a recording apparatus according to the present invention may be used in the form of the facsimile apparatus as above described, an image output terminal for the information processing equipment such as a word processor or a computer, integrally or separately provided, or a copying machine in combination with a reader.

Figure 9:
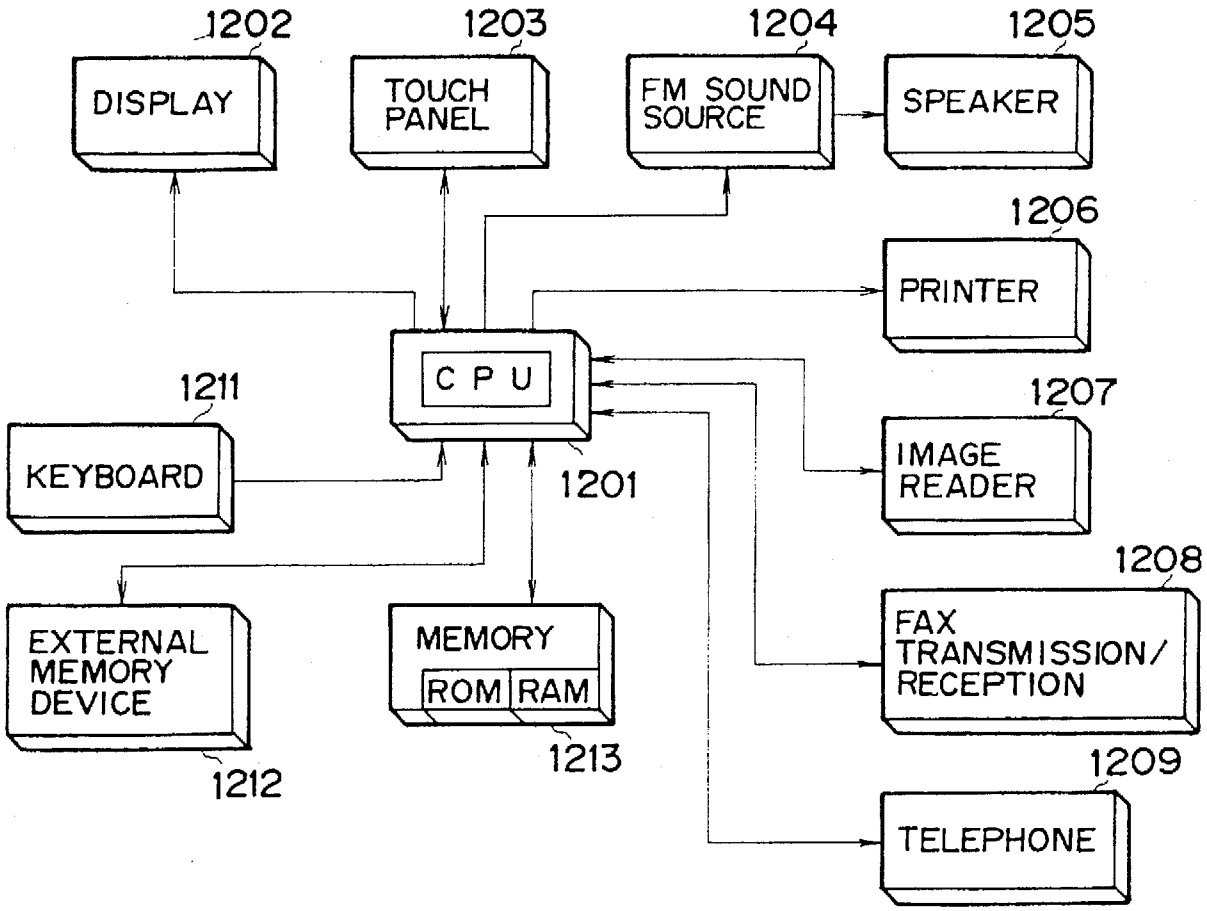
FIG. 9 is a block diagram illustrating the schematic configuration of the liquid jetting apparatus according to the present invention as applied to an information processing apparatus.

FIG. 9 is a block diagram showing a schematic configuration in which a recording apparatus of the present invention is applied to the information processing apparatus having the features of word processor, personal computer, facsimile apparatus, and copying machine. In the figure, 1201 is a control unit for controlling the whole apparatus, comprised of a CPU such as a microprocessor or various I/O ports, this control unit controlling each unit by sending or receiving control or data signals to or from it. 1202 is a display unit for displaying various menus, document information, and image data read with an image reader 1207 on its display screen. 1203 is a transparent, pressure sensitive touch panel provided on the display unit 1202, which enables the entry of items or coordinate values on the display unit 1202 by depressing its surface with a finger or the like.

1204 is a FM (Frequency Modulation) sound source unit, which makes the FM modulation for the music information created with a music editor, this information being stored in a memory 1213 or an external storage device 1212 as the digital data and read therefrom. An electrical signal from the FM sound source unit 1204 is converted into an audible sound by a speaker unit 1205. A printer unit 1206 consists of a recording apparatus according to the present invention as the output terminal for a word processor, a personal computer, a facsimile apparatus, or a copying machine.

1207 is an image reader unit for photoelectrically reading original data to be input, which is provided midway on original conveying passage to read facsimile or copying original, and other various kinds of originals. 1208 is a FAX transmission or reception unit for FAX transmitting original data read by the image reader unit 1207 or receiving and decoding facsimile signals transmitted thereto, this unit having an interface facility with the outside. 1209 is a telephone unit, comprising various telephone functions, such as an ordinary telephone function or an automatic answering telephone function. 1213 is a memory unit comprised of a ROM for storing a system program, manager programs and other application programs, character fonts, and dictionaries. A RAM for storing application programs or document information loaded from the external storage device 1212, and a video RAM.

1211 is a keyboard unit useful for inputting document information or various kinds of command. 1212 is an external storage device, which is a storage medium consisting of a floppy disk or a hard disk, for the storage of document information, music or audio data, and user's application programs.

Figure 10:
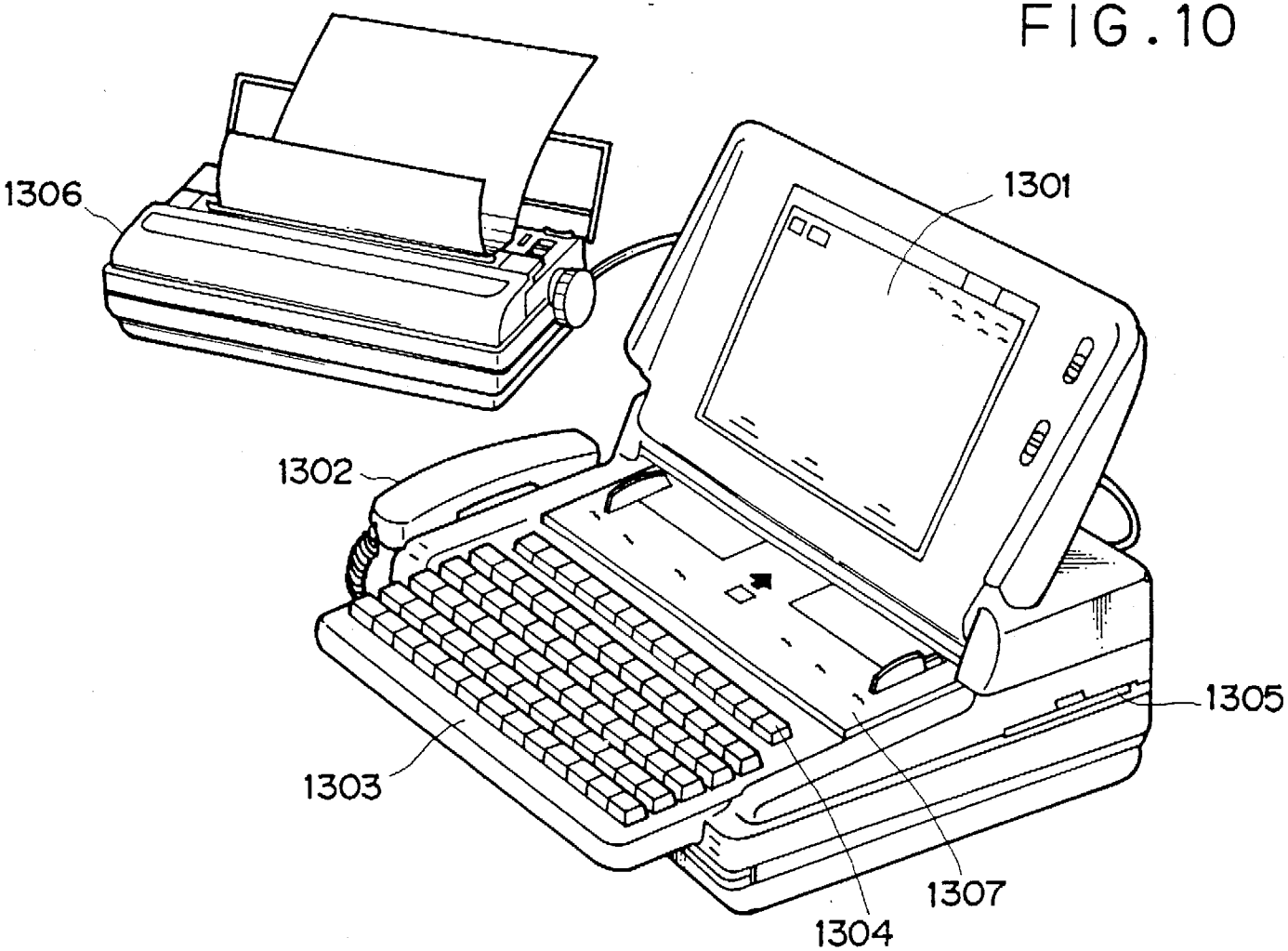
FIG. 10 is an external view of the information processing apparatus.

FIG. 10 is a typical appearance view of the information processing apparatus as shown in FIG. 9. In the figure, 1301 is a flat panel display utilizing liquid crystal or the like for displaying various means, graphic data or documents. On this display 1301 is installed the touch panel 1203, which enables the entry of coordinates or item specifications by depressing the surface of the touch panel 1203 with a finger or the like. 1302 is a handset for use when the apparatus functions as a telephone.

A keyboard 1303 is detachably connected via a cord to the main body, and is used to input various documents or data. Also, the keyboard 1303 is provided with various function keys 1304. 1305 is an opening for insertion of the floppy disk.

1307 is a sheet feed board for placing thereon a paper to be read by the image reader unit 1207, the read paper being exhausted out of the rear side of device. In the facsimile reception, received data is recorded by an ink jet printer 1307.

Figure 11:
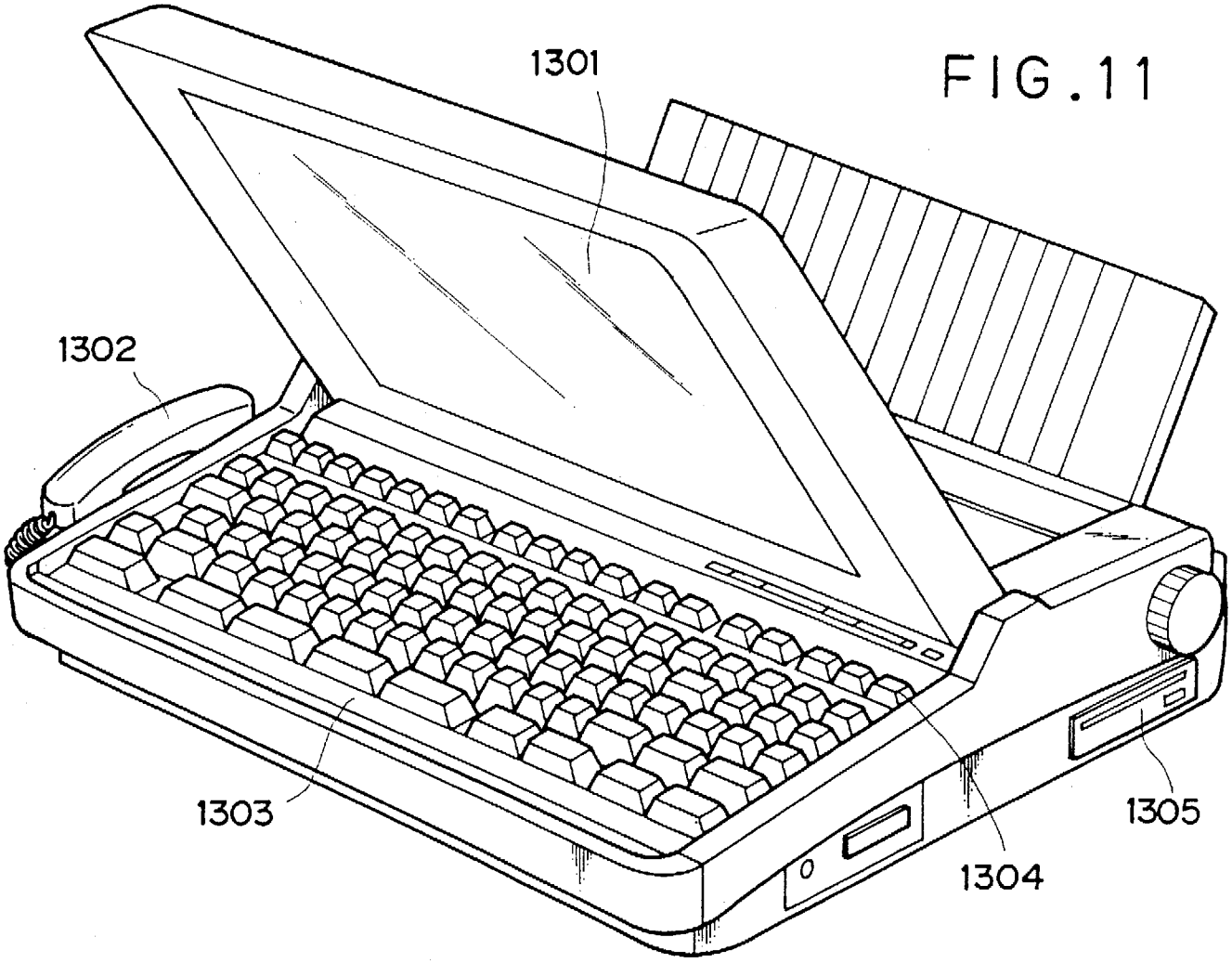
FIG. 11 is an external view illustrating another example of information processing apparatus.

It should be noted that the display unit 1202 as above described may be a CRT, but is preferably a flat panel of the liquid crystal display using a ferroelectric liquid crystal, because it can be more compact, in addition to be thinner and lighter. When the above-noted information processing device functions as a word processor, various document information input from the keyboard 1211 are processed according to a document processing program by the control unit 1201 as shown in FIG. 9, and output as the image to the printer 1206. When such information processing device functions as a personal computer, various kinds of data input from the keyboard 1211 is calculated in accordance with an application program by the control unit 1201, with its calculated result output as the image to the printer unit 1206. When it functions as a receiver for the facsimile apparatus, facsimile information input from the FAX transmission/reception unit 1208 via the communication line are received according to a predetermined program by the control unit 1201, and output to the printer unit 1206 as the received image. And when it functions as a copying machine, an original is read by the image reader unit 1207, and read original data is output via the control unit 1201 to the printer unit 1206 as the copied image. Note that it functions as a transmitter for the facsimile apparatus, original data read by the image reader unit 1207 is processed for transmission according to a predetermined program by the control unit 1201, and transmitted via the FAX transmission/reception unit 1208 to the communication line. It should be noted that the above-noted information processing device can be an integral type incorporating an ink jet printer within the main body, as shown in FIG. 11, in which its portability can be enhanced. In the same figure, like reference numerals are affixed to parts having the same functions as those in FIG. 10.

If a recording apparatus of the present invention is applied to the multifunctional type information processing device as above described, higher quality recording image can be obtained so that the functions of the information processing device can be further improved.

As above described, since according to the present invention, a driver for capping means is controlled so that the liquid jetting region of a liquid jetting head is covered with capping means upon the detection that the liquid jetting head is exchanged, the reliable capping is assured, and with a cap placed into close contact with the discharge orifice face, the clogging of nozzles is prevented so that the suction recovery operation is reliably performed.

Also, according to the present invention, after discharge recovery means performs discharge recovery operation on the basis of an instruction from instructing means for instructing discharge recovery operation, the recording head is automatically driven to record a checking image onto the recording medium, whereby the operator can readily confirm whether or not the ink undischarge is resolved.

What is claimed is:

1. A liquid jetting apparatus for jetting the liquid employing a liquid jetting head, comprising:

a mounting section for mounting the liquid jetting head;

a covering member for covering a liquid jetting region of said liquid jetting head, wherein said covering member at least partially covers the liquid jetting region following a operation for manually mounting the liquid jetting head on the mounting section;

driving means for driving said covering member;

detecting means for detecting information regarding whether said liquid jetting head is mounted on the mounting section; and control means for controlling the driving of said covering member by said driving means, wherein said control means controls said driving means, to separate said covering member covering the liquid jetting region in association with the operation for manually mounting the liquid jetting head on the mounting section once away from the liquid jetting region of said liquid jetting head, and then controls said covering member to cover again and to establish an airtight capping seal with respect to the liquid jetting region.

2. A liquid jetting apparatus according to claim 1, further comprising liquid jetting recovery means for performing a liquid jetting recovery by acting on the liquid jetting region of said liquid jetting head.

3. A liquid jetting apparatus according to claim 2, wherein said liquid jetting recovery means comprises means for effecting a suction force to the liquid jetting region in a state in which said covering member covers said liquid jetting region so as to suck the liquid from the liquid jetting region after the covering member again covers the liquid jetting region.

4. A liquid jetting apparatus according claim 1, wherein said liquid jetting head is an ink jet recording head which performs the recording by discharging ink onto a recording medium.

5. A liquid jetting apparatus according to claim 4, wherein said ink jet recording head is a recording head for discharging the ink by the use of heat energy, comprising thermal energy generating members for generating the heat energy to be applied to the ink.

6. A liquid jetting apparatus according to claim 5, wherein said recording head causes a state change in the ink by the heat energy applied by said heat energy converters to discharge the ink from said liquid jetting region based on said state change.

7. An image forming apparatus for jetting the liquid employing a liquid jetting head, comprising: covering member at least partially covers the liquid jetting region following an operation for manually mounting the liquid jetting head on the mounting section;

driving means for driving said covering member;

detecting means for detecting information regarding whether said liquid jetting head is mounted on the mounting section;

control means for controlling the driving of said covering member by said driving means, wherein said control means controls said driving means to separate said covering member covering the liquid jetting region in association with the operation for manually mounting the liquid jetting head on the mounting section once away from the liquid jetting region of said liquid jetting head, and then controls said covering member to cover again and to establish an airtight capping seal with respect to the liquid jetting region; and at least one of transmitting means for transmitting and receiving means for receiving information of an image recordable by said liquid jetting head.

8. An image forming apparatus according to claim 7, further comprising original image reading means for reading original image information to be recorded by said liquid jetting head.

9. An image forming apparatus for jetting the liquid employing a liquid jetting head, comprising:

a mounting section for mounting the liquid jetting head;

a covering member for covering a liquid jetting region of said liquid jetting head, wherein said covering member at least partially covers the liquid jetting region following an operation for manually mounting the liquid jetting head on the mounting section;

driving means for driving said covering member;

detecting means for detecting information regarding whether said liquid jetting head is mounted on the mounting section;

control means for controlling the driving of said covering member by said driving means, wherein said control means controls said driving means to separate said covering member covering the liquid jetting region in association with the operation for manually mounting the liquid jetting head on the mounting section once away from the liquid jetting region of said liquid jetting head, and then controls said covering member to cover again and to establish an airtight capping seal with respect to the liquid jetting region; and original image reading means for reading original image information to be recorded by said liquid jetting head.

10. An image forming apparatus for jetting the liquid employing a liquid jetting head, comprising:

a mounting section for mounting the liquid jetting head;

a covering member for covering a liquid jetting region of said liquid jetting head, wherein said covering member at least partially covers the liquid jetting region following an operation for manually mounting the liquid jetting head on the mounting section;

driving means for driving said covering member;

detecting means for detecting information regarding whether said liquid jetting head is mounted on the mounting section;

control means for controlling the driving of said covering member by said driving means, wherein said control means controls said driving means to separate said covering member covering the liquid jetting region in association with the operation for manually mounting the liquid jetting head on the mounting section once away from the liquid jetting region of said liquid jetting head, and then controls said covering member to cover again and to establish an airtight capping seal with respect to the liquid jetting region; and recording signal input means for inputting recording signals used by said image forming apparatus.

11. An image forming apparatus according to claim 10, wherein said recording signal input means is a keyboard.

12. An information processing device for jetting the liquid employing a liquid jetting head, comprising:

a mounting section for mounting the liquid jetting head;

a covering member for covering a liquid jetting region of said liquid jetting head, wherein said covering member at least partially covers the liquid jetting region following an operation for manually mounting the liquid jetting head on the mounting section;

driving means for driving said covering member;

detecting means for detecting information regarding whether said liquid jetting head is mounted on the mounting section;

control means for controlling the driving of said covering member by said driving means, wherein said control means controls said driving means to separate said covering member covering the liquid jetting region in association with the operation for manually mounting the liquid jetting head on the mounting section once away from the liquid jetting region of said liquid jetting head and then controls said covering member to cover again and to establish an airtight capping seal with respect to the liquid jetting region; and calculation processing means for processing image information to be recorded by said liquid recording head.

13. A method for covering by covering member a liquid jetting region of a liquid jetting apparatus for jetting liquid by using a liquid jetting head having the liquid jetting region, said method comprising the steps of:

providing a mounting section for mounting the liquid jetting head;

providing drive means for driving said covering member;

for at least partially covering by said covering member the liquid jetting region following an operation for manually mounting said liquid jetting head on the mounting section; and controlling said drive means to separate said covering member covering the liquid jetting region of said liquid jetting head once away from the liquid jetting region and then controlling said covering member to cover again and to establish an airtight capping seal with respect to the liquid jetting region.

* * * * *

UNITED STATES PATENT AND TRADEMARK OFFICE

CERTIFICATE OF CORRECTION

PATENT NO. : 5,742,302

DATED : April 21, 1998

INVENTOR(S) : SHINICHIRO KOHRI ET AL.

It is certified that error appears in the above-identified patent and that said Letters Patent is hereby corrected as shown below:

COLUMN 5

Line 23, "operation" should read --operation.--;
Line 28, "6r" should read --or--;
Line 29, "step" should read --step S14.--;
Line 30, "S14." should be deleted; and
Line 55, "assured" should read --assured.--.

COLUMN 10

Line 13, "means," should read --means--; and
Line 46, "comprising: covering" should read
--comprising:
a mounting section for mounting the liquid jetting head;
a covering member for covering a liquid jetting region of said liquid jetting head, wherein said covering--.

UNITED STATES PATENT AND TRADEMARK OFFICE

CERTIFICATE OF CORRECTION

PATENT NO. : 5,742,302

DATED : April 21, 1998

INVENTOR(S) : SHINICHIRO KOHRI ET AL.

It is certified that error appears in the above-identified patent and that said Letters Patent is hereby corrected as shown below:

COLUMN 12

Line 32, "by" should read --by a--.

Signed and Sealed this

Thirtieth Day of May, 2000

*Attest:*

*Attesting Officer*

Q. TODD DICKINSON

*Director of Patents and Trademarks*